US010635048B2

(12) United States Patent
Hirakawa et al.

(10) Patent No.: US 10,635,048 B2
(45) Date of Patent: Apr. 28, 2020

(54) TRANSFER UNIT COMPRISING ALTERNATING CURRENT BIAS AND HUMIDIFYING UNIT

(71) Applicant: FUJI XEROX CO., LTD., Tokyo (JP)

(72) Inventors: Noboru Hirakawa, Kanagawa (JP); Yoko Miyamoto, Kanagawa (JP); Masaaki Takahashi, Kanagawa (JP); Koichiro Yuasa, Kanagawa (JP); Yoshiyuki Tominaga, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/293,581

(22) Filed: Mar. 5, 2019

(65) Prior Publication Data

US 2020/0081397 A1 Mar. 12, 2020

(30) Foreign Application Priority Data

Sep. 7, 2018 (JP) ..... 2018-167778

(51) Int. Cl.
*G03G 15/16* (2006.01)
*G03G 21/20* (2006.01)

(52) U.S. Cl.
CPC ..... *G03G 21/203* (2013.01); *G03G 15/161* (2013.01)

(58) Field of Classification Search
CPC ..... G03G 21/203
USPC ..... 399/97
See application file for complete search history.

(56) References Cited

U.S. PATENT DOCUMENTS

| | | | | |
|---|---|---|---|---|
| 8,781,348 | B2 | 7/2014 | Ogino et al. | |
| 9,291,934 | B2 | 3/2016 | Shimizu et al. | |
| 10,197,951 | B2 * | 2/2019 | Sakurai | B65H 23/044 |
| 2014/0079418 | A1 * | 3/2014 | Tanaka | G03G 15/1605 399/44 |
| 2017/0329263 | A1 * | 11/2017 | Sugiura | G03G 15/1665 |

FOREIGN PATENT DOCUMENTS

| | | | |
|---|---|---|---|
| JP | 06324544 | A * | 11/1994 |
| JP | 2005-164919 | | 6/2005 |
| JP | 2005164919 | A * | 6/2005 |
| JP | 2008-065025 | | 3/2008 |
| JP | 2012-042827 | | 3/2012 |
| JP | 2013097060 | A * | 5/2013 |
| JP | 2013-231936 | | 11/2013 |

OTHER PUBLICATIONS

Computer translation of JP2013097060A to Aoki et al. (Year: 2013).*
Computer translation of JP2005-164919A to Komata (Year: 2005).*

* cited by examiner

*Primary Examiner* — Quana Grainger
(74) *Attorney, Agent, or Firm* — JCIPRNET

(57) ABSTRACT

A transfer device includes a transfer unit that transfers an image on an image carrier carrying the image onto a first surface of a recording material by applying a voltage containing an alternating-current component to the recording material; and a humidifying unit that humidifies the recording material transported toward the transfer unit from a second surface of the recording material that is opposite to the first surface.

7 Claims, 7 Drawing Sheets

TRANSFER UNIT COMPRISING ALTERNATING CURRENT BIAS AND HUMIDIFYING UNIT

CROSS-REFERENCE TO RELATED APPLICATIONS

This application is based on and claims priority under 35 USC 119 from Japanese Patent Application No. 2018-167778 filed Sep. 7, 2018.

BACKGROUND

(i) Technical Field

The present disclosure relates to a transfer device and an image forming apparatus.

(ii) Related Art

Conventionally, a transfer device that transfers an image by applying a transfer voltage to a recording material and an image forming apparatus including such a transfer device are known.

For example, Japanese Unexamined Patent Application Publication No. 2005-164919 discloses an image forming apparatus that humidifies a surface of a transfer material on which a toner image is not transferred.

For example, Japanese Unexamined Patent Application Publication No. 2012-42827 discloses a transfer device that transfers a toner image on an image carrier onto a recording material at a transfer nip position by applying a transfer bias that is a superimposed bias in which a direct-current component and an alternating-current component are superimposed on each other.

Conventionally, combined use of a transfer bias (alternating-current bias) containing an alternating-current component and humidification is not employed because of concern about leakage of an alternating current via a humid recording material.

SUMMARY

Aspects of non-limiting embodiments of the present disclosure relate to providing a transfer device and an image forming apparatus that have higher transfer performance than in a case where one of an alternating-current bias and humidification is used.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a transfer device including a transfer unit that transfers an image on an image carrier carrying the image onto a first surface of a recording material by applying a voltage containing an alternating-current component to the recording material; and a humidifying unit that humidifies the recording material transported toward the transfer unit from a second surface of the recording material that is opposite to the first surface.

BRIEF DESCRIPTION OF THE DRAWINGS

An exemplary embodiment of the present disclosure will be described in detail based on the following figures, wherein.

DETAILED DESCRIPTION

An exemplary embodiment of the present disclosure is described below with reference to the drawings.

Figure 1:
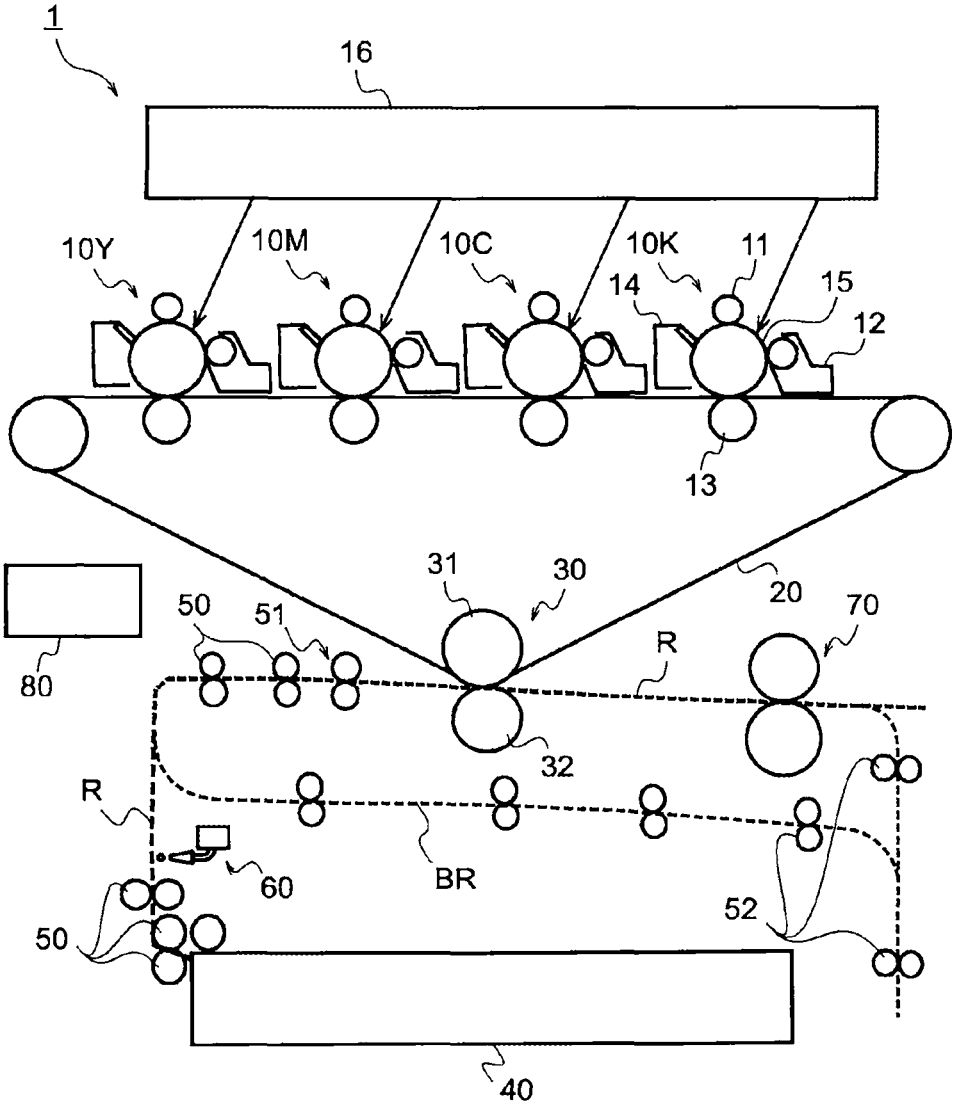
FIG. 1 schematically illustrates a configuration of a printer that is an exemplary embodiment of an image forming apparatus according to the present disclosure.

FIG. 1 schematically illustrates a configuration of a printer that is an exemplary embodiment of an image forming apparatus according to the present disclosure.

A printer 1 is a tandem-system color printer and includes four image engines 10Y, 10M, 10C, and 10K that form toner images of respective four colors (Y, M, C, and K). Furthermore, the printer 1 includes an exposure unit 16 common to these four image engines 10Y, 10M, 10C, and 10K.

Each of the image engines 10Y, 10M, 10C, and 10K forms a toner image, for example, according to an electrophotographic system. Each of the image engines 10Y, 10M, 10C, and 10K has a structure in which a charging unit 11, a developing unit 12, a first transfer unit 13, and a cleaner 14 are disposed in this order around a cylindrical photo conductor 15. In each of the image engines 10Y, 10M, 10C, and 10K, charging, exposure, and development are sequentially performed on the photo conductor 15 by the charging unit 11, the exposure unit 16, and the developing unit 12, respectively. In this way, toner images of the colors corresponding to the image engines 10Y, 10M, 10C, and 10K are formed on the photo conductors 15.

The printer 1 includes an intermediate transfer belt 20 that circulates while passing the image engines 10Y, 10M, 10C, and 10K, and the toner images of the respective colors formed by the image engines 10Y, 10M, 10C, and 10K are transferred onto the intermediate transfer belt 20 by the first transfer units 13 so as to be superimposed on one another. The cleaner 14 removes toner, paper powder, and the like remaining on the photo conductor 15 after the transfer.

The toner images of the respective colors transferred onto the intermediate transfer belt 20 are superimposed on one another so as to form a color image on the intermediate transfer belt 20. The color image on the intermediate transfer belt 20 is transported to a second transfer unit 30 by circulating movement of the intermediate transfer belt 20.

A paper tray 40 in which sheets of paper that are one kind of recording material are stored so as to be superimposed on one another is provided below the printer 1. For example, any sheets of paper selected from among plain paper having a flat surface, cardboards thicker than plain paper and having a flat surface, and embossed paper thicker than plain paper and having an uneven surface are stored in the paper tray 40. The kind of sheets of paper stored in the paper tray 40 is registered in a controller 80 that controls the whole printer 1.

A sheet of paper is extracted from the paper tray 40 by transport rollers 50 and is fed upward along a transport path R. A humidifier 60 is disposed on the transport path R and gives moisture to a back surface of the sheet of paper opposite to a front surface on which an image is to be formed.

The sheet of paper whose back surface has been moisturized is transported further upward on the transport path R and is fed to register rollers 51 by the transport rollers 50.

The register rollers 51 feed the sheet of paper to the second transfer unit 30 in synchronization with a timing at which the color image on the intermediate transfer belt 20 reaches the second transfer unit 30. The second transfer unit 30 transfers, onto the sheet of paper, the color image on the intermediate transfer belt 20 by applying a voltage while sandwiching the sheet of paper between a backup roller 31 and a transfer roller 32. The intermediate transfer belt 20 is an example of an image carrier according to the present disclosure.

The sheet of paper onto which the image has been transferred is further transported on the transport path R and is fed to a fixing unit 70. The fixing unit 70 fixes the image on the sheet of paper onto the sheet of paper by applying heat and pressure to the sheet of paper.

The sheet of paper onto which the image has been fixed is delivered to an outside of the printer 1 in a case of single-side printing in which an image is formed only on a single surface of the sheet of paper. Meanwhile, in a case of two-side printing in which an image is formed on both surfaces of the sheet of paper, the sheet of paper is fed to a return transport path BR by return transport rollers 52 and thus returns to an upstream side of the transport path R.

Since the front and back surfaces of the sheet of paper are reversed in the middle of transport on the return transport path BR, a surface that was previously a back surface becomes a new front surface. A position to which the sheet of paper is returned is a downstream side of the humidifier 60. The front surface of the sheet of paper returned to an upstream side of the transport path R through the return transport path BR has been dried by heat of the fixing unit 70, but moisture remains inside the sheet of paper. Therefore, the sheet of paper is not humidified again.

A combination of the return transport rollers 52 and the return transport path BR is an example of a returning unit according to the present disclosure.

The sheet of paper returned to the upstream side of the transport path R is fed to the register rollers 51 without passing the humidifier 60, and an image is transferred and fixed onto the new front surface in a procedure similar to that described above. The sheet of paper on which the image has been fixed is delivered to an outside of the printer 1.

In the second transfer unit 30 of the printer 1, a transfer voltage in which a direct-current component and an alternating-current component are superimposed on each other is used as a transfer voltage (transfer bias) for transferring an image. Hereinafter, such a transfer voltage containing an alternating-current component is sometimes referred to as an "alternating-current bias".

A part from the humidifier 6 to the second transfer unit 30 of the printer 1 is an example of an exemplary embodiment of a transfer device according to the present disclosure.

Figure 2:
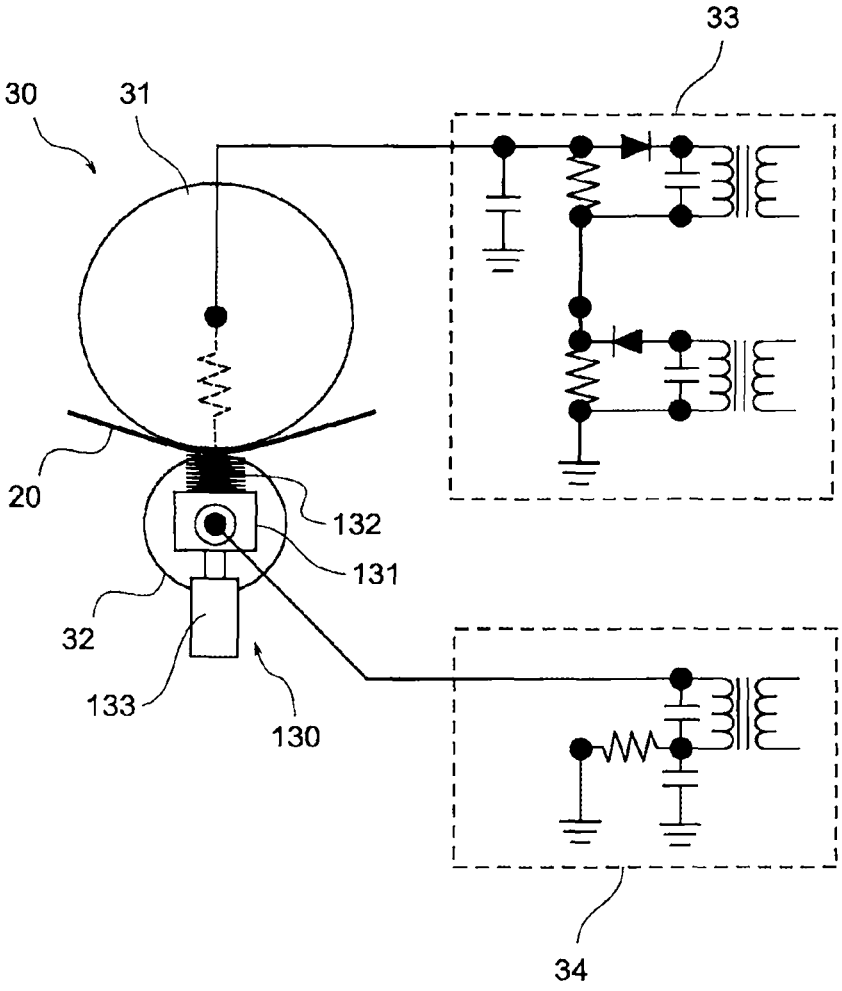
FIG. 2 illustrates a structure for applying a voltage to a second transfer unit.

FIG. 2 illustrates a structure for applying a voltage to the second transfer unit 30.

In the present exemplary embodiment, for example, a direct-current voltage is applied from the front-surface side of the sheet of paper and an alternating-current voltage is applied from the back-surface side of the sheet of paper. That is, a direct-current power source 33 is connected to the backup roller 31, and a direct-current voltage is applied to the sheet of paper from the front-surface side of the sheet of paper through the backup roller 31 and the intermediate transfer belt 20.

Meanwhile, an alternating-current power source 34 is connected to the transfer roller 32, and an alternating-current voltage is applied to the sheet of paper from the back-surface side of the sheet of paper through the transfer roller 32. The alternating-current power source 34 is used in accordance with the kind of sheet of paper. For example, the alternating-current power source 34 is on in a case where the sheet of paper is a sheet of paper, such as embossed paper, having an uneven surface, and the alternating-current power source 34 is off in a case where the sheet of paper is a sheet of paper, such as plain paper or a cardboard, having a flat surface.

The second transfer unit 30 also includes a changing mechanism 130 that changes a pressure (transfer nip pressure) by which the sheet of paper is nipped by the backup roller 31 and the transfer roller 32. The changing mechanism 130 includes a shaft bearing 131 movable in a top-down direction in FIG. 2 relative to a frame (not illustrated) of the second transfer unit 30, and a rotary shaft of the transfer roller 32 is rotatably supported by the shaft bearing 131. Furthermore, the changing mechanism 130 includes a pressing spring 132 that presses the shaft bearing 131 from an upper side of FIG. 2 and an actuator 133 that pushes the shaft bearing 131 upward from a lower side of FIG. 2.

The actuator 133 is driven under control of the controller 80 (see FIG. 1) so that the shaft bearing 131 moves in the up-down direction in FIG. 2. When the shaft bearing 131 moves upward in FIG. 2, the transfer roller 32 approaches the backup roller 31. This increases the transfer nip pressure. When the shaft bearing 131 moves downward in FIG. 2, the transfer roller 32 is moved away from the backup roller 31. This decreases the transfer nip pressure.

The transfer nip pressure is switched in accordance with the kind of sheet of paper. For example, a transfer nip pressure for plain paper is higher than a transfer nip pressure for a cardboard. Furthermore, for example, a transfer nip pressure for embossed paper is lower than a transfer nip pressure for a cardboard and is equal to or higher than a transfer nip pressure for plain paper.

The second transfer unit 30 illustrated in FIG. 2 is an example of a transfer unit according to the present disclosure.

Figure 3:
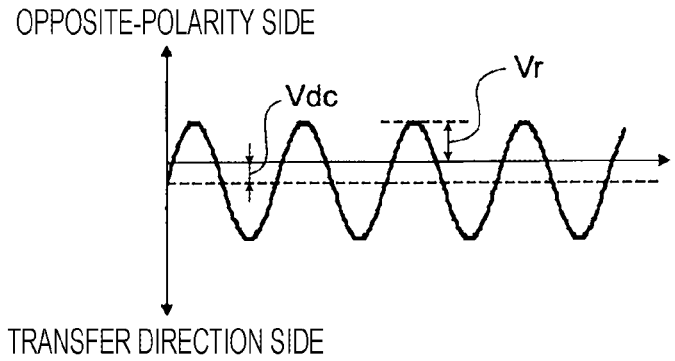
FIG. 3 is a graph illustrating a transfer voltage having a sinusoidal waveform.
Figure 4:
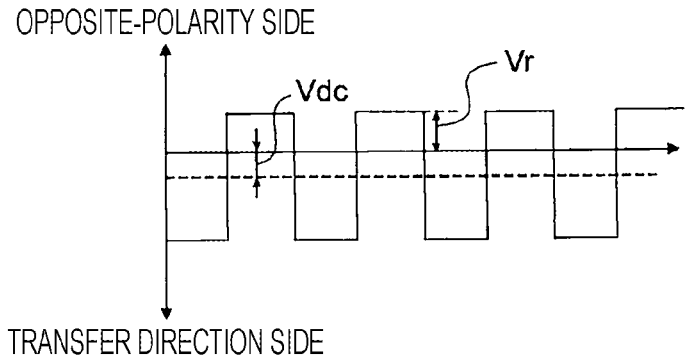
FIG. 4 is a graph illustrating a transfer voltage having a rectangular waveform.
Figure 5:
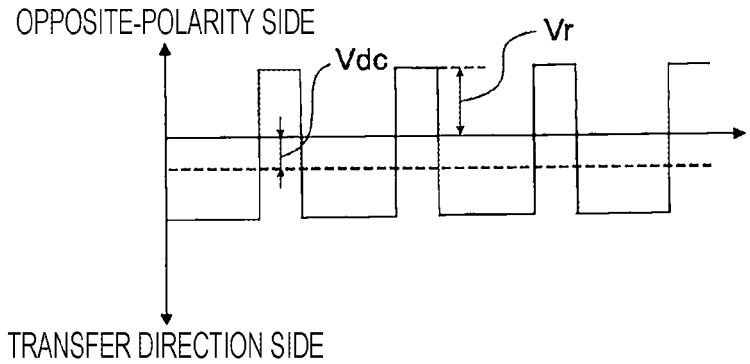
FIG. 5 is a graph illustrating another example of a transfer voltage having a rectangular waveform.

FIGS. 3 through 5 are graphs illustrating an example of a transfer voltage applied to the sheet of paper.

In each of the graphs, the horizontal axis represents time, and the vertical axis represents a voltage. A voltage below the horizontal axis of the graph is a voltage (positive-polarity voltage) of a polarity for transferring an image (toner of the image) onto the sheet of paper, and a voltage above the horizontal axis of the graph is a voltage (reverse-polarity voltage) of a polarity for returning toner from the sheet of paper to the intermediate transfer belt 20.

FIG. 3 illustrates a transfer voltage having a sinusoidal waveform.

Part of the voltage having a sinusoidal waveform is a reverse-polarity voltage, but large part of the sinusoidal voltage is a positive-polarity voltage. Since part of the sinusoidal voltage is a reverse-polarity voltage, part of transferred toner returns to the intermediate transfer belt 20 and collides with toner remaining on the intermediate transfer belt 20. This allows the toner on the intermediate transfer belt 20 to be easily detached from the intermediate transfer belt 20. This improves image transfer performance.

A direct-current component Vdc and a return component Vr in the waveform of the transfer voltage are described below. The direct-current component Vdc corresponds to (an absolute value of) an average voltage in the voltage waveform of the transfer voltage and represents average transfer power of the whole waveform of the transfer voltage. The return component Vr is a maximum value in a part on the reverse-polarity side of the waveform of the transfer voltage and represents an intensity of temporary return of toner.

FIG. 4 illustrates a transfer voltage having a rectangular waveform.

In the case of the rectangular wave illustrated in FIG. 4, a temporal ratio of a positive-polarity side voltage and a reverse-polarity side voltage is 1:1. However, since the positive-polarity side voltage is larger than the reverse-polarity side voltage, the whole transfer voltage acts to transfer an image.

FIG. 5 illustrates another example of a transfer voltage having a rectangular waveform.

In the case of the rectangular wave illustrated in FIG. 5, the positive-polarity side voltage and the reverse-polarity side voltage are equivalent to each other. However, a period of the positive-polarity side voltage is longer than a period of the reverse-polarity side voltage, and therefore the whole transfer voltage acts to transfer an image.

Figure 6:
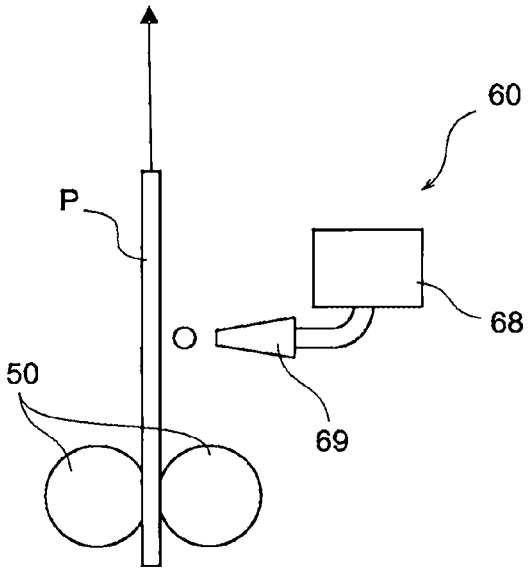
FIG. 6 illustrates a structure of a humidifier.

FIG. 6 illustrates a structure of a humidifier.

The humidifier 60 includes a water tank 68 and a nozzle 69. The humidifier 60 ejects, from the nozzle 69, water supplied from the water tank 68 toward the back surface of the sheet of paper P transported in a direction indicated by the arrow in FIG. 6 by the transport rollers 50 according to an inkjet method. That is, the humidifier 60 illustrated in FIG. 6 is an example of a non-contact-type humidifier that gives moisture to the sheet of paper P in a non-contact manner.

The humidifier 60 switches whether to perform humidification depending on the kind of sheet of paper under control of the controller 80 (see FIG. 1). For example, the humidifier 60 does not perform humidification on a sheet of paper, such as plain paper or a cardboard, having a flat surface and performs humidification on a sheet of paper, such as embossed paper, having an uneven surface.

The humidifier according to the present disclosure may be a contact-type humidifier that gives moisture to the sheet of paper P in a contact manner.

Figure 7:
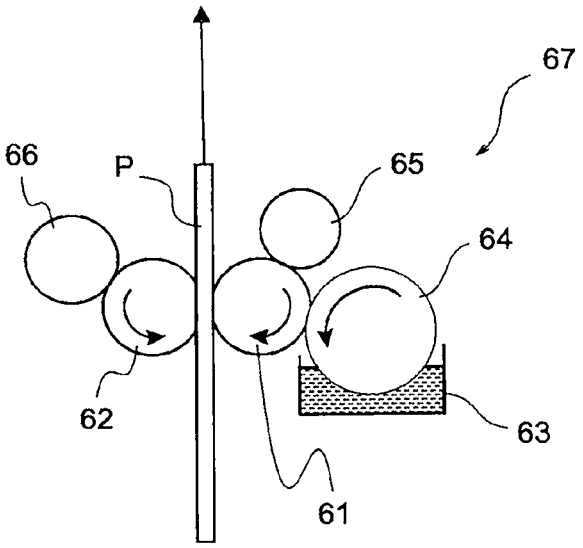
FIG. 7 illustrates an example of a contact-type humidifier.

FIG. 7 illustrates an example of a contact-type humidifier.

A contact-type humidifier 67 includes, for example, a pair of sponge rollers 61 and 62 that sandwich a sheet of paper P and a supply roller 64 that supplies water in a tank 63 to one sponge roller 61. Furthermore, the contact-type humidifier 67 also includes water-absorbing rollers 65 and 66 that absorb excess water from the sponge rollers 61 and 62. The contact-type humidifier 67 also gives moisture to a back surface of the sheet of paper P.

In the printer 1 illustrated in FIG. 1, the contact-type humidifier 67 illustrated in FIG. 7 may be used instead of the non-contact-type humidifier 60 illustrated in FIG. 6.

In the printer 1 illustrated in FIG. 1, an alternating-current bias and back-surface humidification are used in combination for a sheet of paper, such as embossed paper, having an uneven surface. An effect of such combined use is described below.

Figure 8:
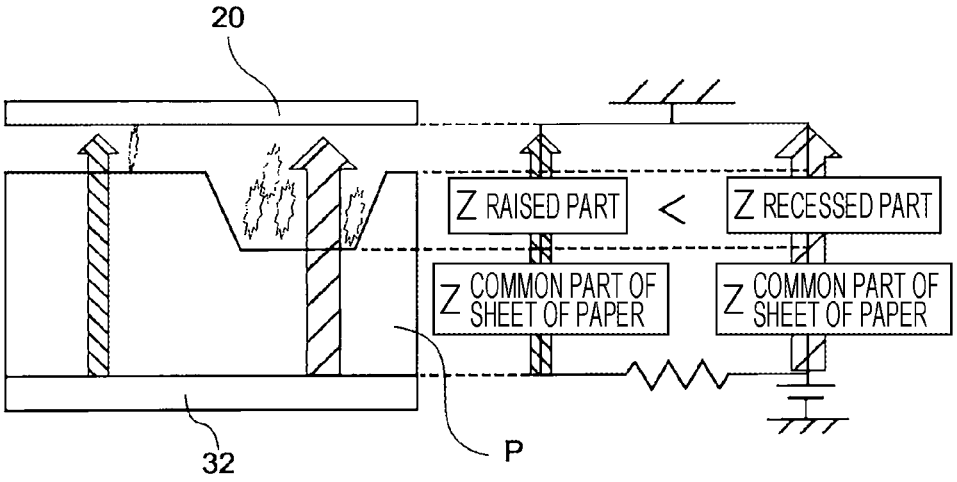
FIG. 8 illustrates an effect obtained in a case where an alternating-current bias is used without back-surface humidification.

FIG. 8 illustrates an effect obtained in a case where an alternating-current bias is used without back-surface humidification.

The left part of FIG. 8 illustrates the sheet of paper P sandwiched between the intermediate transfer belt 20 and the transfer roller 32, and the right part of FIG. 8 illustrates an electrical state of the sheet of paper P.

In a case where the sheet of paper P sandwiched between the intermediate transfer belt 20 and the transfer roller 32 is paper having large unevenness such as embossed paper, a raised part and a recessed part of the sheet of paper P have different thicknesses, and therefore an electrical path from the transfer roller 32 to the intermediate transfer belt 20 include an air layer in the recessed part. Accordingly, a path reaching to the intermediate transfer belt 20 through the recessed part has higher impedance than a path reaching to the intermediate transfer belt 20 through the raised part. This leads to a risk of application of a high voltage to the recessed part and occurrence of electric discharge. The electric discharge in the recessed part causes shortage of a transfer voltage, thereby causing defective transfer.

Figure 9:
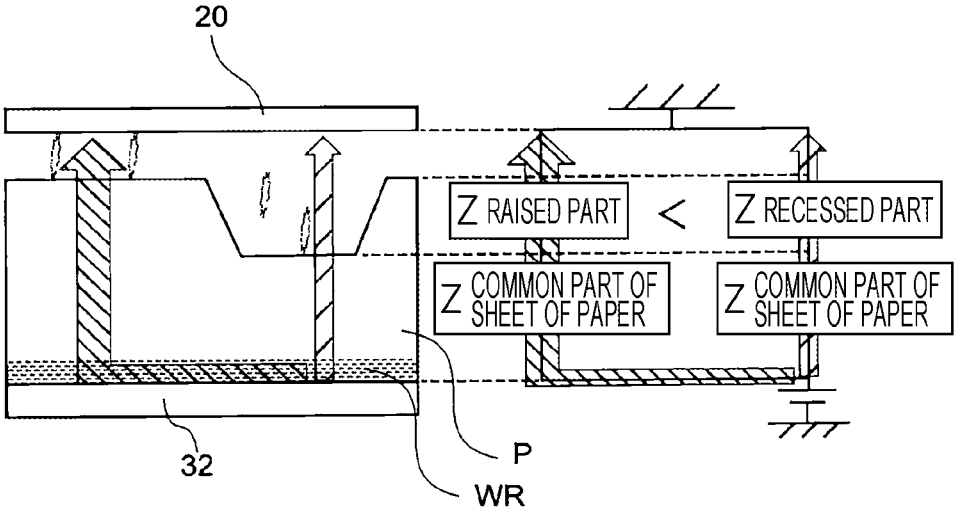
FIG. 9 illustrates an effect obtained in a case where back-surface humidification is performed and an alternating-current bias is used.

FIG. 9 illustrates an effect obtained in a case where back-surface humidification is performed and an alternating-current bias is used.

The left part of FIG. 9 illustrates the sheet of paper P sandwiched between the intermediate transfer belt 20 and the transfer roller 32, and the right side of FIG. 9 illustrates an electric state of the sheet of paper P.

In a case where back-surface humidification is performed, a humidification region WR is formed on a back surface of the sheet of paper P that is in contact with the transfer roller 32. Accordingly, in a case where a high voltage occurs in a path passing the recessed part, an electric current escapes to the raised part side through the humidification region WR. This avoids electric discharge in the recessed part, thereby obtaining a sufficient transfer voltage in the whole sheet of paper P.

Figure 10:
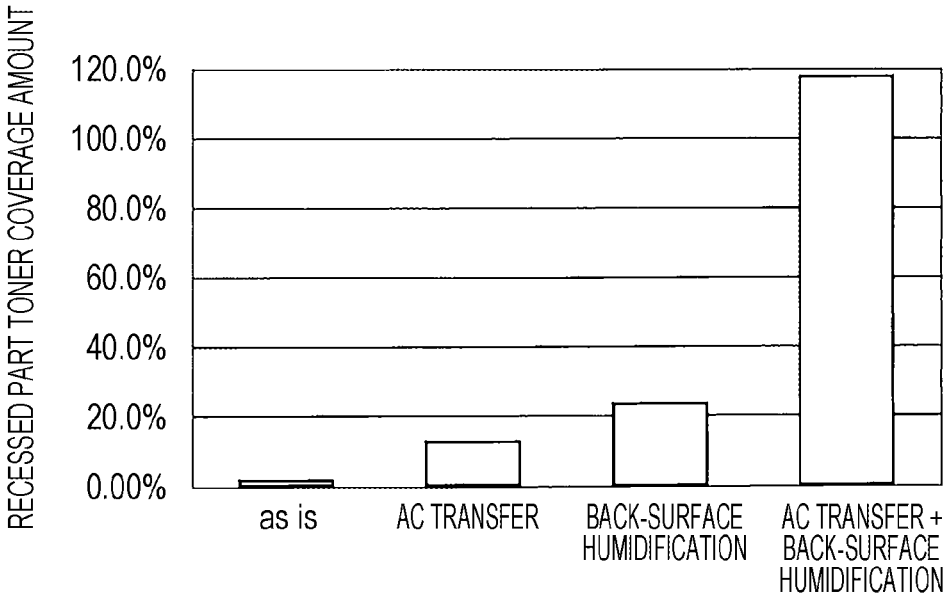
FIG. 10 is a graph comparing transfer performance in different transfer methods.

FIG. 10 is a graph comparing transfer performance in different transfer methods.

The vertical axis in the graph represents a ratio of a dot percentage of a halftone image after transfer to a dot percentage of the halftone image before the transfer in a recessed part of a sheet of paper.

In a case where a direct-current transfer voltage is used without back-surface humidification (as is), only approximately several percent of the dot percentage before the transfer are transferred, whereas in a case where an alternating-current bias is used without back-surface humidification and in a case where a direct-current transfer voltage is used and back-surface humidification is performed, approximately 15% to 25% of the dot percentage before the transfer are transferred. That is, an alternating-current bias or back-surface humidification alone contributes to an improvement in transfer performance, but only approximately ¼ of the dot percentage before the transfer is transferred even after the improvement, and a difference from a raised part is remarkable. This cannot address shortage of transfer performance in the recessed part.

In a case of the transfer method using an alternating-current bias and back-surface humidification in combination, a dot percentage after transfer is higher by nearly 20% than a dot percentage before the transfer. This increase in area percentage is caused because experimental conditions are not optimum and therefore halftone dots are deformed. This result shows that transfer performance in the recessed part can be made equivalent to transfer performance in the raised part by optimizing the transfer conditions.

As described above, combined use of an alternating-current bias and back-surface humidification remarkably improves transfer performance as compared with a case where an alternating-current bias or back-surface humidification is used alone. Although there were concerns that combined use of an alternating-current bias and back-surface humidification decreases transfer performance due to leakage of an alternating-current voltage through a humid back surface, such leakage actually does not occur or a measure against such leakage is easy.

The transfer method using an alternating-current bias and back-surface humidification in combination obtains high transfer performance for a sheet of paper, such as embossed paper, having an uneven surface, but another transfer method is desirably used for other kinds of paper. In the present exemplary embodiment, for example, a transfer method is switched in accordance with the kind of paper by the controller 80. That is, the transfer method using an alternating-current bias and back-surface humidification in combination is employed for a sheet of paper, such as embossed paper, having an uneven surface, and a transfer method using one of an alternating-current bias and back-surface humidification or a transfer method using a direct-current transfer voltage without back-surface humidification is employed for a sheet of paper, such as plain paper or a cardboard, having small surface unevenness.

Since plain paper and a cardboard have no recessed part, a difference in transfer performance between a raised part and a recessed part does not pose a problem. Accordingly, there is no need to take a special measure for improvement of transfer performance in the recessed part, and too high transfer performance has a risk of causing troubles such as a stain in a background region. In view of this, a transfer method suitable for the kind of paper is used, and thus desirable transfer performance is obtained for any kinds of paper.

Next, appropriate conditions of a transfer voltage and humidification in combined use of an alternating-current bias and back-surface humidification are considered.

Figure 11:
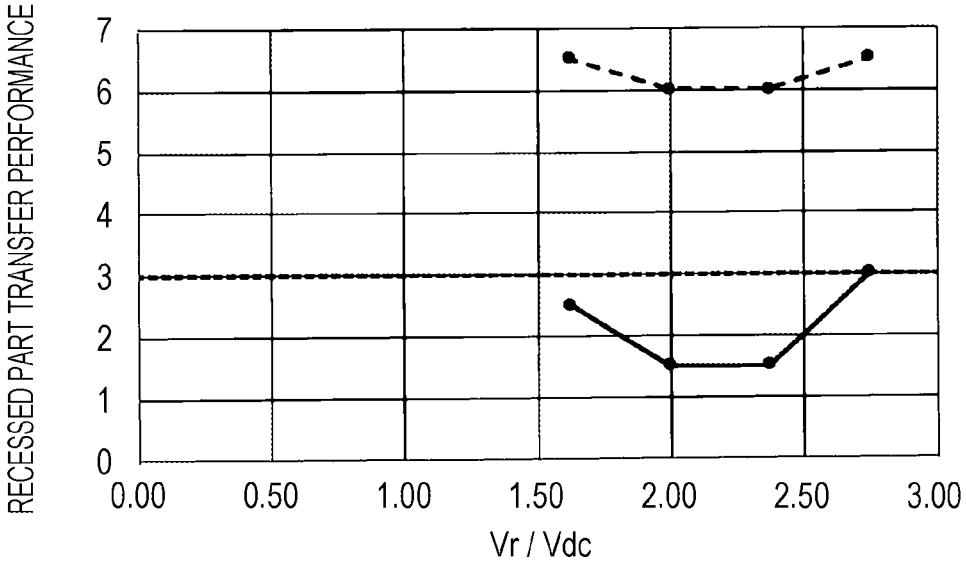
FIG. 11 is a graph illustrating a relationship between a transfer voltage and transfer performance.

FIG. 11 is a graph illustrating a relationship between a transfer voltage and transfer performance.

In the graph, the horizontal axis represents a ratio of the return component Vr to the direct-current component Vdc, and the vertical axis represents an evaluation value concerning failure of arrival of transfer toner at a recessed part. A larger value of the vertical axis indicates poorer transfer performance, and in a case where the value is 3 or more, a difference between the recessed part and the raised part is observed.

The graph indicated by the dotted line represents a result of transfer using an alternating-current bias without back-surface humidification. In this case, transfer performance is very poor. Meanwhile, the graph indicated by the solid line represents a result of transfer using an alternating-current bias and back-surface humidification in combination. Within the range indicated by the graph indicated by the solid line, the evaluation value is basically 3 or less. This shows that an observable difference does not occur between a raised part and a recessed part. The evaluation value increases at ends of the graph, and in a case where a value of Vr/Vdc is outside the graph, a difference between the recessed part and the raised part is sometimes observed. Accordingly, it is desirable that the value of Vr/Vdc be used as an index of a transfer voltage and be set within a range from 1.6 to 2.75 inclusive.

Figure 12:
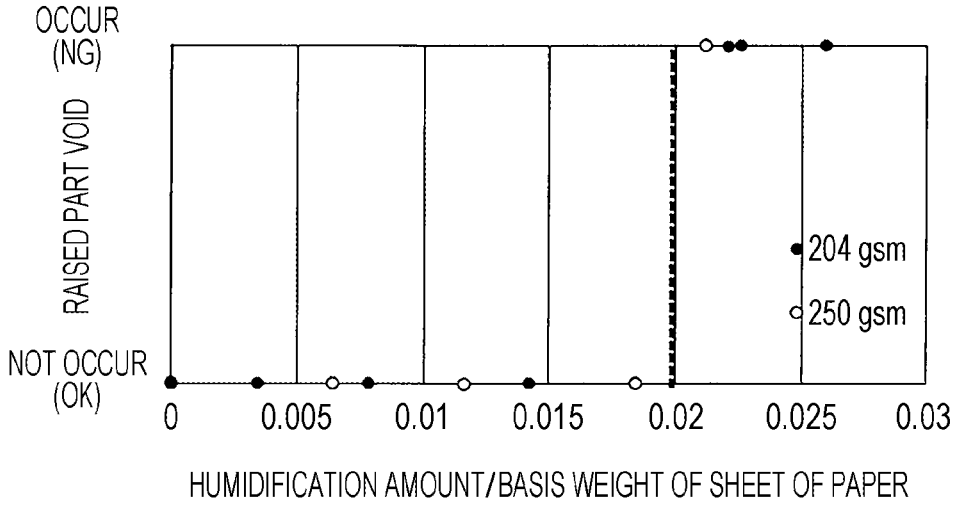
FIG. 12 illustrates a relationship between a humidification amount and an image defect.

FIG. 12 illustrates a relationship between a humidification amount and an image defect.

In FIG. 12, the horizontal axis represents a value obtained by dividing an amount of water used for humidification per unit area of a sheet of paper by a basis weight of the sheet of paper, and the vertical axis represents presence or absence of a void in the raised part of the sheet of paper. In a case where an amount of humidification of the sheet of paper is large, moisture reaches to a front surface of the sheet of paper. As a result, in the raised part, electric discharge occurs because an electric charge concentrates at a front-end part such as a raised fiber. This causes shortage of a transfer voltage in this part, leading to occurrence of a void.

FIG. 12 illustrates a result of an experiment conducted on a sheet of paper having a basis weight of 204 gsm and a sheet of paper having a basis weight of 250 gsm. FIG. 12 shows that a void occurs in a raised part irrespective of a difference in basis weight in a case where a value of the horizontal axis exceeds 0.02. Accordingly, an upper limit of the amount of humidification is 0.02 or less in a case where a value obtained by dividing an amount of water used for humidification per unit area of the sheet of paper by a basis weight of the sheet of paper is used as an index.

Figure 13:
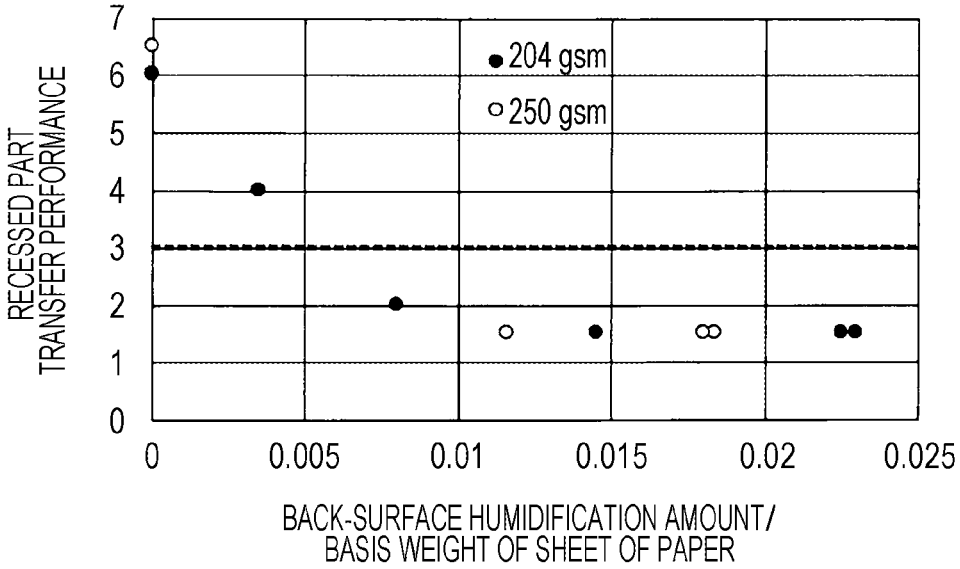
FIG. 13 is a graph illustrating a relationship between a humidification amount and transfer performance.

FIG. 13 is a graph illustrating a relationship between an amount of humidification and transfer performance.

In the graph, the horizontal axis represents a value obtained by dividing an amount of water used for humidification per unit area of a sheet of paper by a basis weight of the sheet of paper, and the vertical axis represents an evaluation value concerning failure of arrival of transfer toner at a recessed part.

FIG. 13 illustrates a result of an experiment conducted on a sheet of paper having a basis weight of 204 gsm and a sheet of paper having a basis weight of 250 gsm. FIG. 13 shows that transfer performance in a recessed part decreases irrespective of a difference in basis weight as a value of the horizontal axis becomes smaller and that a difference between a recessed part and a raised part becomes observable when the value of the horizontal axis becomes smaller than 0.005. Accordingly, a lower limit of the amount of humidification is 0.005 or more in a case where a value obtained by dividing an amount of water used for humidification per unit area of the sheet of paper by a basis weight of the sheet of paper is used as an index. Furthermore, when the value of the horizontal axis exceeds 0.01, the evaluation value becomes almost constant. This shows that transfer performance becomes stable. Accordingly, the amount of humidification is desirably 0.01 or more in a case where a value obtained by dividing an amount of water used for humidification per unit area of the sheet of paper by a basis weight of the sheet of paper is used as an indicator.

Desirable transfer performance is realized by combined use of an alternating-current bias and back-surface humidification with the use of desirable transfer voltage and amount of humidification described above.

Although an indirect-transfer-type color printer using an intermediate transfer belt is illustrated in the above description, the image forming apparatus according to the present disclosure may be a black-and-white printer or may be a direct-transfer-type printer. In a case where the image forming apparatus according to the present disclosure is a direct-transfer-type printer, a photo conductor is an example of an image carrier according to the present disclosure.

Although a printer is illustrated as an exemplary embodiment of the image forming apparatus according to the present disclosure in the above description, the image forming apparatus according to the present disclosure may be a copying machine, may be a fax machine, or may be a multifunction printer.

Although an electrophotographic image engine is illustrated in the above description, an image forming unit according to the present disclosure may form a toner image according to a system other than an electrophotographic system.

Although the present disclosure has been made for the purpose of solving the problem described in Summary, the configuration of the present disclosure may be used for a different purpose without solving this problem, and such a form in which the configuration of the present disclosure is used for a different purpose is also an exemplary embodiment of the present disclosure.

The foregoing description of the exemplary embodiment of the present disclosure has been provided for the purposes of illustration and description. It is not intended to be exhaustive or to limit the disclosure to the precise forms disclosed. Obviously, many modifications and variations will be apparent to practitioners skilled in the art. The embodiment was chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A transfer device comprising:

a transfer unit that transfers an image on an image carrier carrying the image onto a first surface of a recording material by applying a voltage containing an alternating-current component to the recording material; and a humidifying unit that humidifies the recording material transported toward the transfer unit from a second surface of the recording material that is opposite to the first surface, wherein the humidifying unit humidifies the recording material so that a value obtained by dividing an amount of water used for the humidification per unit area of the recording material by a basis weight of the recording material is approximately 0.02 or less.

2. The transfer device according to claim 1, wherein the humidifying unit humidifies the recording material so that the value obtained by dividing the amount of water used for the humidification per unit area of the recording material by the basis weight of the recording material is approximately 0.005 or more.

3. The transfer device according to claim 2, wherein the humidifying unit humidifies the recording material so that the value obtained by dividing the amount of water used for the humidification per unit area of the recording material by the basis weight of the recording material is approximately 0.01 or more.

4. A transfer device comprising:

a transfer unit that transfers an image on an image carrier carrying the image onto a first surface of a recording material by applying a voltage containing an alternating-current component to the recording material; and a humidifying unit that humidifies the recording material transported toward the transfer unit from a second surface of the recording material that is opposite to the first surface, wherein the voltage applied to the recording material to transfer the image by the transfer unit has a voltage waveform in which a ratio obtained by dividing a maximum amplitude of a waveform part exhibiting a polarity for returning the image toward the image carrier by an absolute value of an average voltage in the voltage waveform is not less than approximately 1.6 and less than approximately 2.75.

5. The transfer device according to claim 1, wherein the recording material is a recording material selected from among a first kind of recording materials having an uneven structure on a surface thereof and a second kind of recording materials having smaller surface unevenness than the first kind of recording materials; and a first kind of transfer in which both of application of the alternating-current component by the transfer unit and execution of humidification by the humidifying unit are employed is applied to the first kind of recording materials, and a second kind of transfer in which at least one of application of the alternating-current component by the transfer unit and execution of humidification by the humidifying unit is not employed is applied to the second kind of recording materials.

6. The transfer device according to claim 5, wherein the recording material is a recording material selected from among the first kind of recording materials, a third kind of recording materials having a first thickness among the second kind of recording materials, and a fourth kind of recording materials having a thickness larger than the first thickness among the second kind of recording materials;

the transfer unit includes a pressing unit that presses the recording material against the image carrier; and first pressing force is applied to the third kind of recording materials by the pressing unit, second pressing force larger than the first pressing force is applied to the fourth kind of recording materials, and third pressing force that is equal to or larger than the first pressing force and is smaller than the second pressing force is applied to the first kind of recording materials.

7. A transfer device comprising:

a transfer unit that transfers an image on an image carrier carrying the image onto a first surface of a recording material by applying a voltage containing an alternating-current component to the recording material; and a humidifying unit that humidifies the recording material transported toward the transfer unit from a second surface of the recording material that is opposite to the first surface, wherein the humidifying unit humidifies the recording material so that the value obtained by dividing the amount of water used for the humidification per unit area of the recording material by the basis weight of the recording material is approximately 0.005 or more.

* * * * *